US008523518B2

(12) United States Patent
Wichmann et al.

(10) Patent No.: US 8,523,518 B2
(45) Date of Patent: Sep. 3, 2013

(54) SYSTEMS, METHODS, AND APPARATUS FOR LINKING MACHINE STATORS

(75) Inventors: Lisa A. Wichmann, Greenville, SC (US); Thomas R. Tipton, Greer, SC (US); Nick Martin, Winter Park, FL (US)

(73) Assignee: General Electric Company, Schenectady, NY (US)

( * ) Notice: Subject to any disclaimer, the term of this patent is extended or adjusted under 35 U.S.C. 154(b) by 679 days.

(21) Appl. No.: 12/389,555

(22) Filed: Feb. 20, 2009

(65) Prior Publication Data

US 2010/0215490 A1 Aug. 26, 2010

(51) Int. Cl.
*F04D 29/44* (2006.01)
*F03B 1/04* (2006.01)

(52) U.S. Cl.
USPC ..... 415/189; 415/119; 415/190; 415/209.2; 415/209.3; 415/209.4; 415/138; 415/139; 29/889.22

(58) Field of Classification Search
USPC ..... 415/119, 139, 189, 190, 209.2, 209.3, 415/209.4, 138; 29/889.22
See application file for complete search history.

(56) References Cited

U.S. PATENT DOCUMENTS

| | | | | |
|---|---|---|---|---|
| 5,022,818 | A * | 6/1991 | Scalzo | 415/209.3 |
| 6,984,108 | B2 | 1/2006 | Anderson et al. | |
| 2008/0118352 | A1 * | 5/2008 | Wheeler et al. | 415/209.2 |

* cited by examiner

*Primary Examiner* — Thao Le
*Assistant Examiner* — Geoffrey Ida
(74) *Attorney, Agent, or Firm* — Sutherland Asbill & Brennan LLP

(57) ABSTRACT

Systems, methods, and apparatus for linking machine stators are provided. A bracket may be utilized to link adjacent stators within a machine, for example, a turbine. The bracket may include a body portion, a first plurality of extensions, and a second plurality of extensions. The body portion may include a first edge operable to align with a base of a first stator and a second edge opposite the first edge and operable to align with a base of a second stator. The first plurality of extensions may extend from the first edge and may be operable to align with at least one corresponding groove on the base of the first stator. The second plurality of extensions may extend from the second edge and may be operable to align with at least one corresponding groove on the base of the second stator. When utilized to link the first stator and the second stator, the bracket may facilitate a reduction of vibrations in the first stator and the second stator.

17 Claims, 6 Drawing Sheets

SYSTEMS, METHODS, AND APPARATUS FOR LINKING MACHINE STATORS

FIELD OF THE INVENTION

This invention generally relates to machines and more specifically, to linking or joining machine stators.

BACKGROUND OF THE INVENTION

Machines, such as turbines, are used in a wide variety of aviation, industrial and power generation applications. Typically, turbine components, such as a compressor or a turbine section of a gas turbine, include a plurality of rotating blades extending from a rotor and a plurality of stationary blades, or stators, extending from a stationary component of the turbine, such as the casing of the turbine. The stators typically extend between the rotating blades of a turbine component. In operation, the stators are typically loaded and unloaded during starting and stopping of the turbine. Additionally, the stators are often subject to small pressure fluctuations during operation. As a result, relative motion or stator rocking may result between the bases of the stators and the casing of the turbine, leading to a flow path within the turbine component that is different than the intended design. This can lead to wear on both the stators and the casing. Additionally, the stator rocking can lead to decreased efficiency, and therefore, decreased power output of a turbine.

Attempts have been made to reduce stator rocking by connecting stators together. One solution involves inserting a pin in the base of a first stator that extends into the base of an adjacent stator. Although the connection of stators with pins reduces stator rocking, given the curvature of the turbine casing, stators connected in this manner often have a gap between their bases. These gaps can lead to losses within the turbine component as a portion of the flow path is diverted between adjoining stator bases.

Accordingly, there is a need for improved systems, methods, and apparatus for linking, joining, or connecting machine stators.

BRIEF DESCRIPTION OF THE INVENTION

According to one embodiment of the invention, there is disclosed a bracket for linking stators in a machine. The bracket may include a body portion, a first plurality of extensions, and a second plurality of extensions. The body portion may include a first edge operable to align with a base of a first stator and a second edge opposite the first edge and operable to align with a base of a second stator. The first plurality of extensions may extend from the first edge and may be operable to align with at least one corresponding groove on the base of the first stator. The second plurality of extensions may extend from the second edge and may be operable to align with at least one corresponding groove on the base of the second stator.

According to another embodiment of the invention, there is disclosed a machine component that may include a casing that surrounds a rotor, a plurality of stators attached to the casing, and a bracket operable to link at least two of the plurality of stators. The brackets may include a body portion, a first plurality of extensions, and a second plurality of extensions. The body portion may include a first edge operable to align with a base of a first stator and a second edge opposite the first edge and operable to align with a base of a second stator. The first plurality of extensions may extend from the first edge and may be operable to align with at least one corresponding groove on the base of the first stator. The second plurality of extensions may extend from the second edge and may be operable to align with at least one corresponding groove on the base of the second stator.

According to yet another embodiment of the invention, there is disclosed a method for linking stators in a machine component. Two stator base members operable to support a respective stator blade may be provided, wherein each of the two base members includes one or more grooves. A bracket may also be provided. The bracket may include a body, a first set of extensions that are receivable by the one or more grooves of a first of the two base members, and a second set of extensions that are receivable by the one or more grooves of the other base member. The two base members may be linked with the bracket within the machine component.

Other embodiments, aspects, and features of the invention will become apparent to those skilled in the art from the following detailed description, the accompanying drawings, and the appended claims.

BRIEF DESCRIPTION OF THE DRAWINGS

Figure 1:
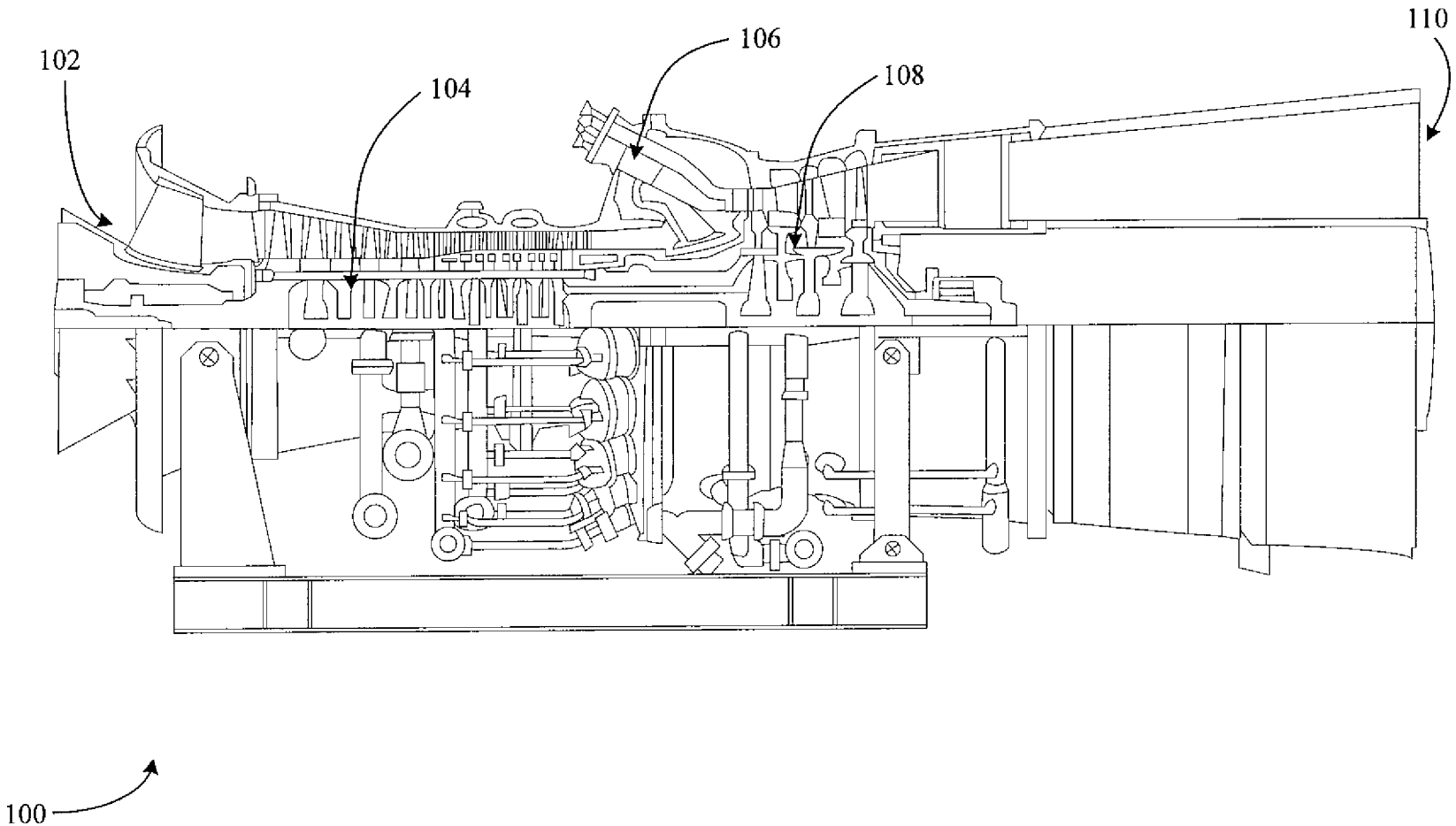

Having thus described the invention in general terms, reference will now be made to the accompanying drawings, which are not necessarily drawn to scale, and wherein:

FIG. 1 is a cross-sectional view of one example of a gas turbine in which embodiments of the invention may be utilized.

Figure 2:
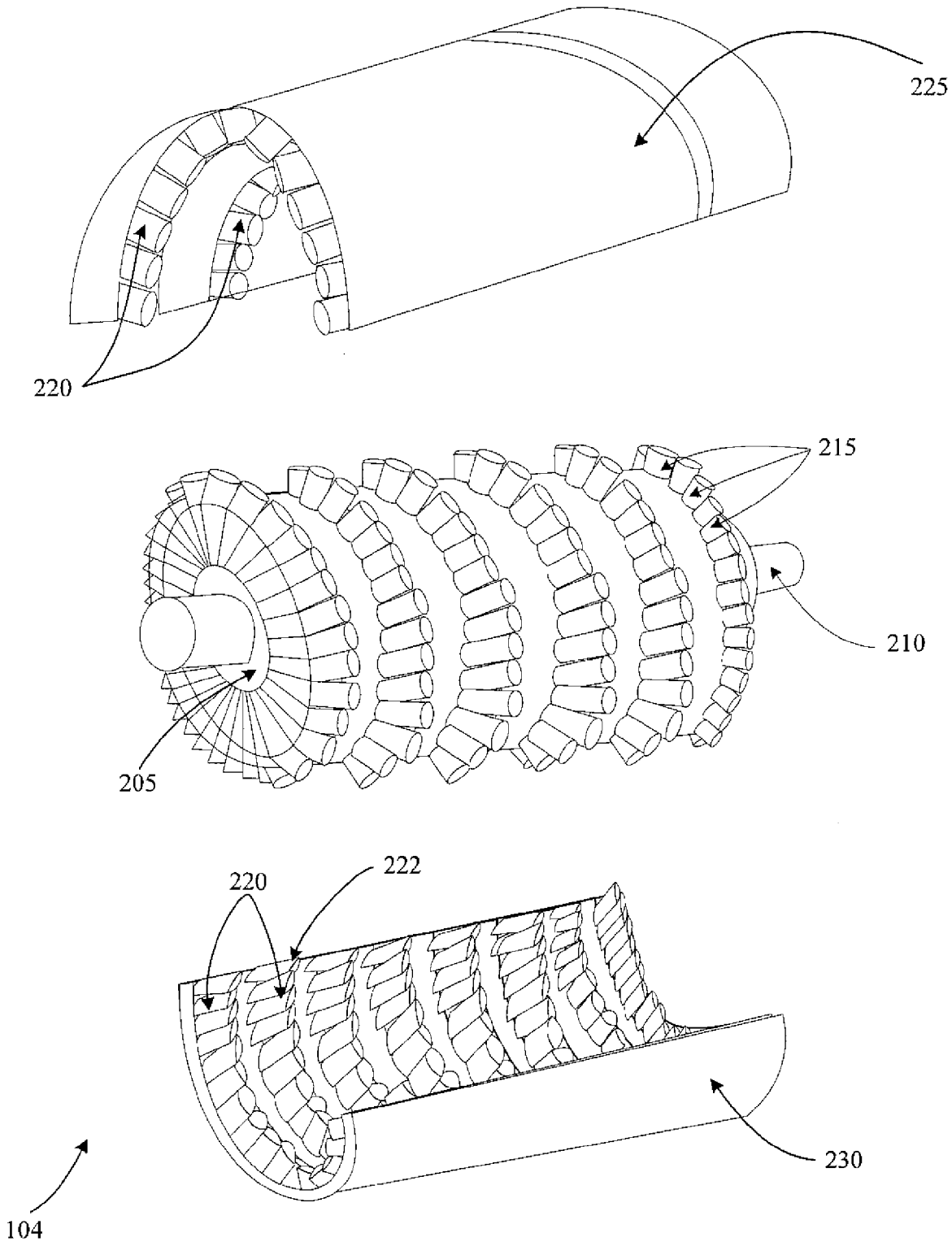

FIG. 2 is a exploded view of a compressor portion of the gas turbine, within which embodiments of the invention may be utilized.

Figure 3:
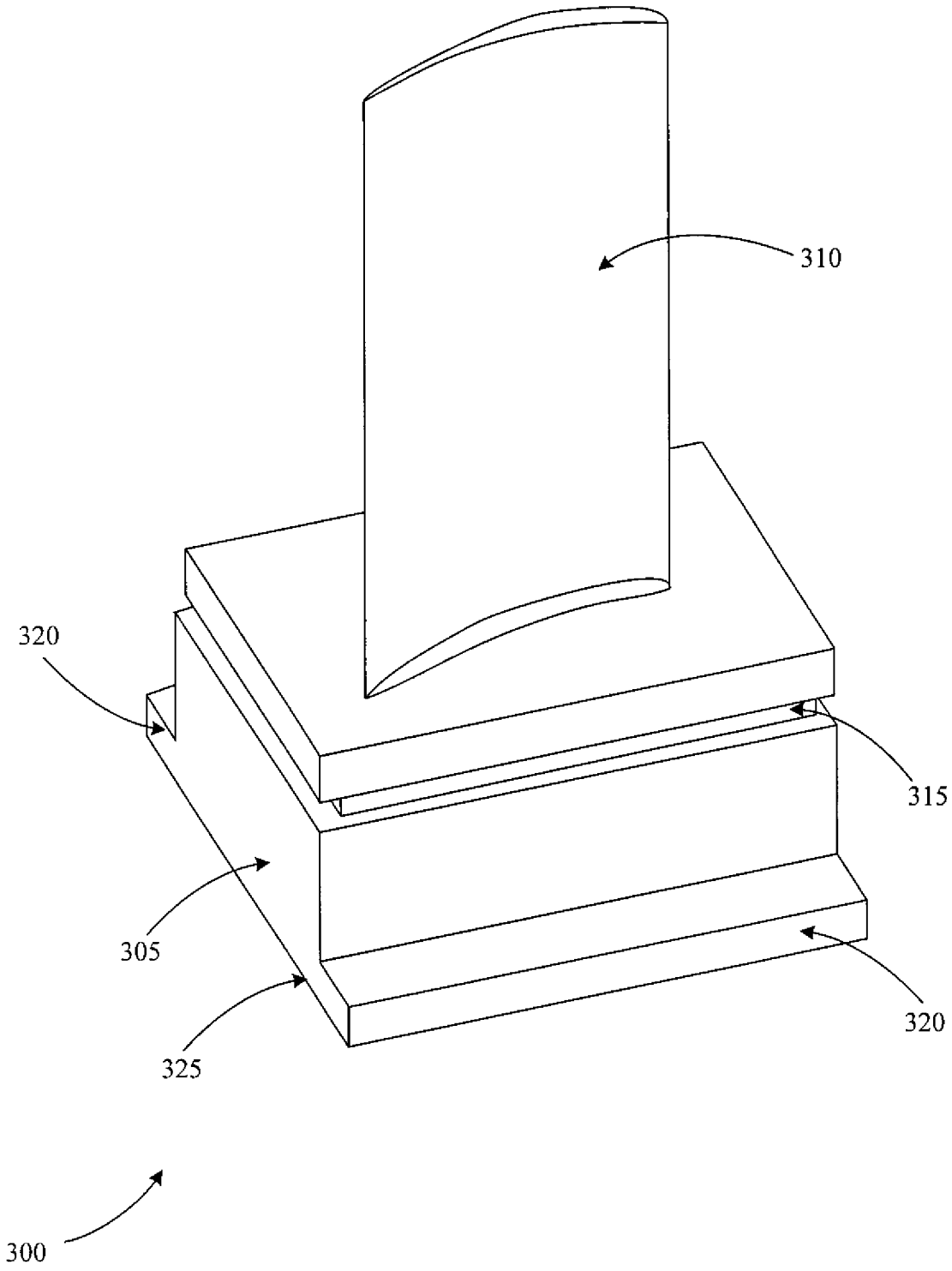

FIG. 3 is a perspective view of one example stator that may be utilized in association with various embodiments of the invention.

Figure 4:
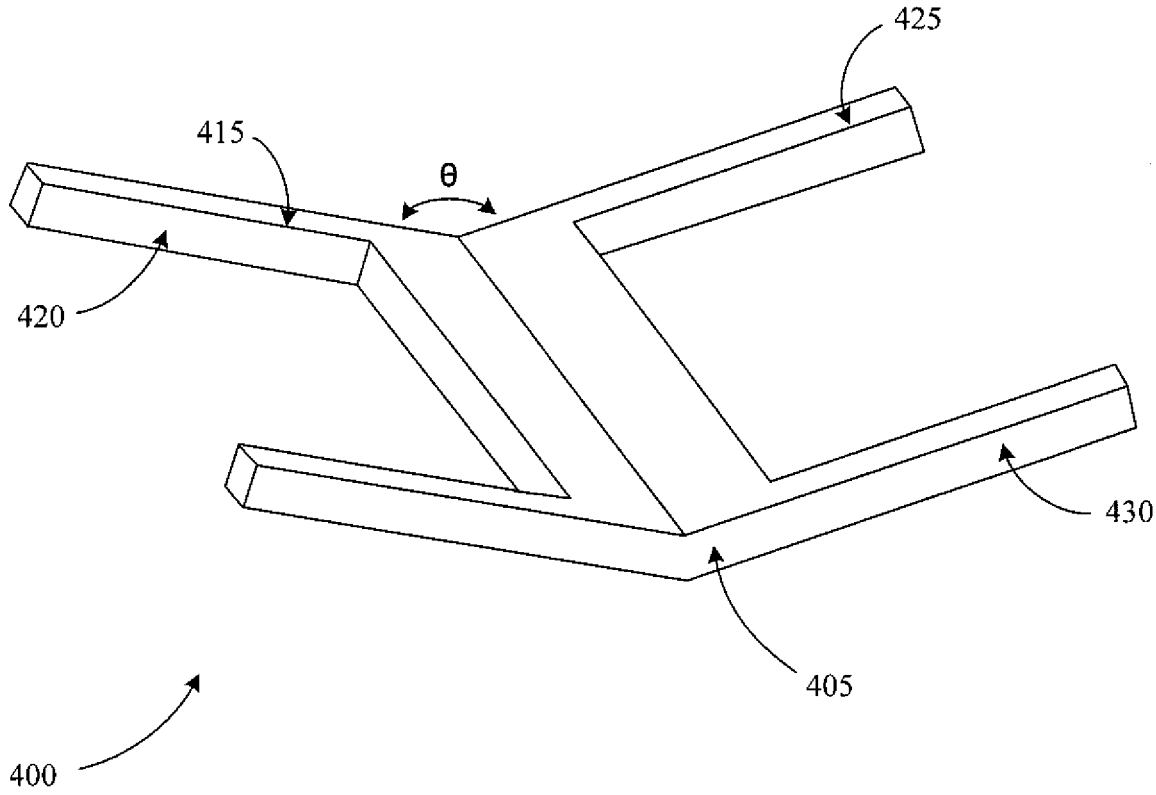

FIG. 4 is a perspective view of one example bracket that may be utilized to link two stators in a turbine, according to an illustrative embodiment of the invention.

Figure 5:
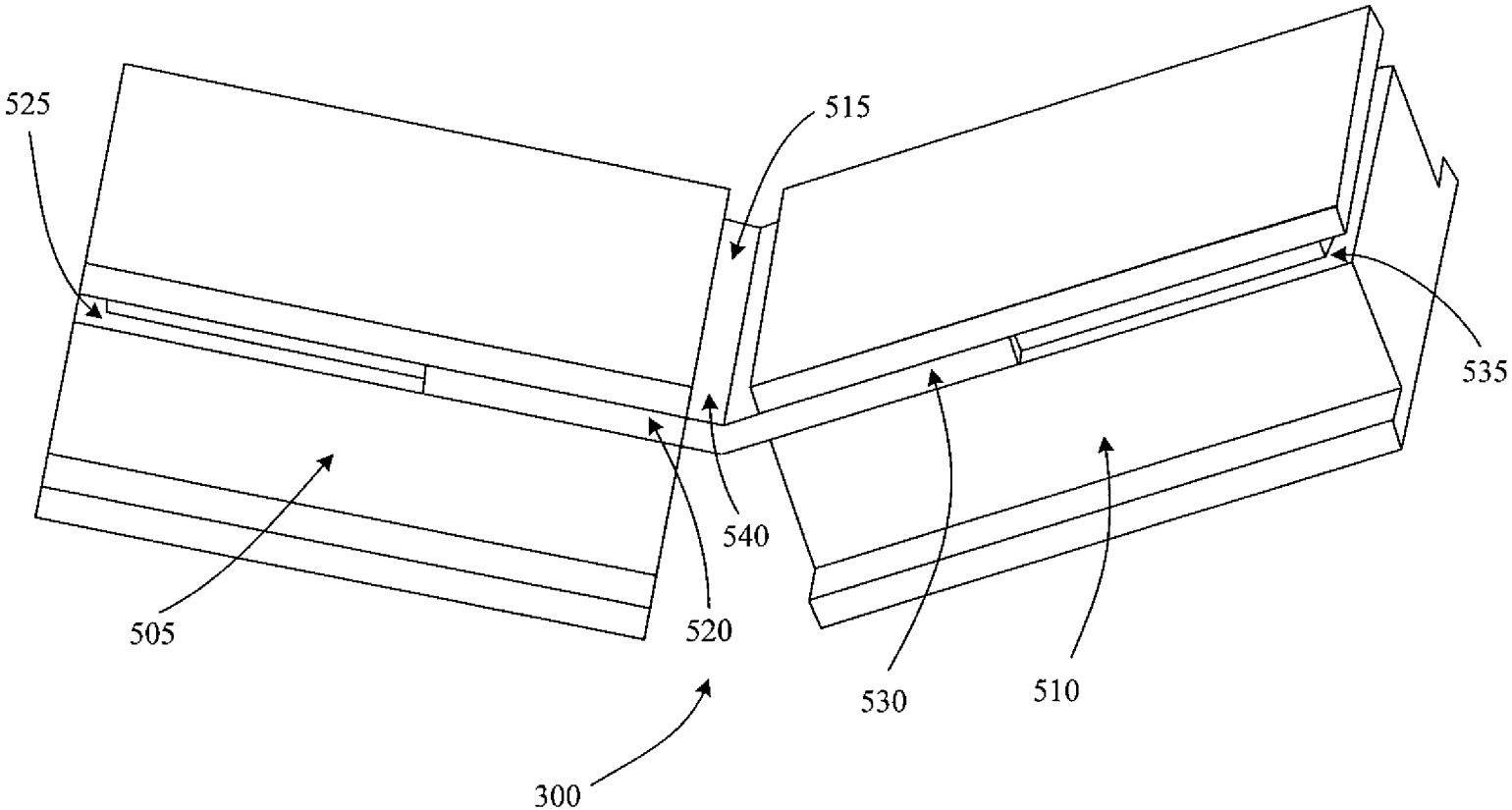

FIG. 5 is a perspective view of two stator bases that have been linked by a bracket in accordance with an illustrative embodiment of the invention.

Figure 6:
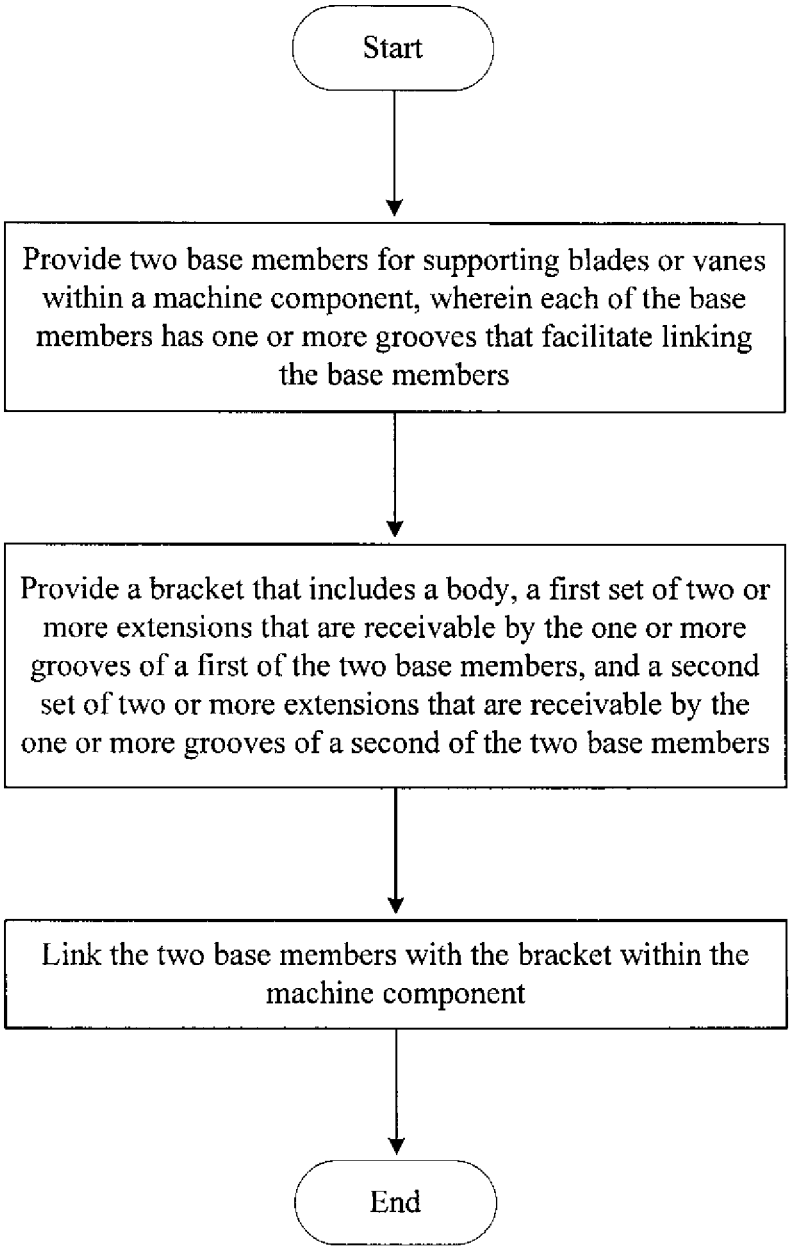

FIG. 6 is a flowchart of one example method for linking stators in a machine, according to an illustrative embodiment of the invention.

DETAILED DESCRIPTION OF THE INVENTION

Illustrative embodiments of the invention now will be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. Like numbers refer to like elements throughout.

Disclosed are systems, methods, and apparatus for linking stators in a machine, such as, a turbine. A bracket may be provided that facilitates linking two or more stators together. The bracket may include a body portion, a first plurality of extensions, and a second plurality of extensions. The body portion may include a first edge operable to align with a base of a first stator and a second edge opposite the first edge and operable to align with a base of a second stator. The first plurality of extensions may extend from the first edge and may be operable to align with at least one corresponding groove on the base of the first stator. The second plurality of extensions may extend from the second edge and may be operable to align with at least one corresponding groove on the base of the second stator. When utilized to link the first stator and the second stator, the bracket may facilitate a reduction of vibrations in the first stator and the second stator. Additionally, the body portion of the bracket may form a surface between the first stator and the second stator that facilitates a reduction in airflow between the first stator and the second stator.

Embodiments of the invention may be utilized in association with a wide variety of different machines. Examples of machines that may incorporate embodiments of the invention include turbines. FIG. 1 illustrates a cross-sectional view of one example of a gas turbine 100 in which embodiments of the invention may be utilized. Although a gas turbine 100 is illustrated in FIG. 1, embodiments of the invention may be utilized in a wide variety of different turbine designs and turbine types including, but not limited to, gas turbines, steam turbines, and other turbines utilized for various aviation, industrial, and/or power generation applications.

With reference to FIG. 1, the illustrated gas turbine 100 may include an intake section 102, a compressor section 104, a combustor section 106, a turbine section 108, and an exhaust section 110. In general operation, air may enter through the intake section 102 and may be compressed to a predefined or predetermined pressure in the compressor section 104. At least a portion of the compressed air from the compressor section 104 may be supplied to the combustion section 106. In the combustion section 106, the compressed air may be mixed with a fuel and then the combined air and fuel mixture may be combusted. The combustion of the air and fuel mixture in the combustion section 106 may produce hot gases having a relatively high temperature and a relatively high pressure. The hot gases coming out of the combustion section 106 may be expanded in the turbine section 108 of the gas turbine 100. The turbine section 108 may convert the energy of the hot gases to rotation energy. Following the expansion of the hot gases in the turbine section 108, relatively low pressure hot gases may be sent out from the gas turbine 100 through the exhaust section 110. The relatively low pressure hot gases coming out from the exhaust section 110 may be sent out to the atmosphere, to a combined cycle regeneration plant, and/or to a recirculation duct of a heat exchanger.

FIG. 2 is a cross-sectional view of a compressor section of a turbine, such as a compressor section 104 of the turbine 100 shown in FIG. 1. The compressor section 104 may include a rotor 205 that is driven or rotated by a shaft 210. The shaft may be driven by a power source, such as, the turbine section 108 of the turbine 100. The rotor 205 may have a plurality of rotor blades, vanes, or buckets 215 attached to it. The plurality of rotor blades 215 may extend from the outer surface of the rotor 205. Additionally, the plurality of rotor blades 215 may be arranged in rows along the outer surface of the rotor 205.

Interposed between the rows of rotor blades 215 may be stator blades or vanes 220. The stator blades 220 may also be arranged in rows and the stator blades 220 may be attached to and extend from a stationary component of the compressor section 104, such as, the housing or casing of the compressor section 104. For purposes of this disclosure, the various rows of rotor blades 215 and stator blades 220 may be referred to as stages of the compressor section 104. Additionally, each of the rows of stator blades 220 may be attached to housing or casing by being inserted into a slot associated with a corresponding row or stage of the compressor section 104. For example, a respective slot, such as slot 222, may be provided in the casing for each row or stage of stator blades.

The housing or casing of the compressor section 104 may include a plurality of components that may be connected to form a casing around the rotor 205 and the rotor blades 215. As shown in FIG. 2, the housing or casing may include a first component 225 and a second component 230 that may be connected to one another around the rotor 205; however, the housing or casing may include any number of components as desired in various embodiments of the invention. As shown, the first component 225 and the second component 230 may each be semi-circular portions that are fitted together to encircle the rotor 205. For example, the first component 225 and the second component 230 may each have an approximately one hundred and eighty degree (180°) curvature. The two components 225, 230 may encircle the rotor 205 when joined or connected together.

During operation, as the shaft 210 rotates, air may be compressed as it moves through various stages of the compressor section 104 with the rotor blades 215 and the stator blades 220 directing the air. The movement of the air may place resulting forces on the rotor blades 215 and the stator blades 220. The rotation of the rotor 205 may create a centrifugal force that minimizes or prevents movement of the rotor blades 215; however, relative motion may occur between the stator blades 220 and the casing 225, 230. As explained in greater detail below, embodiments of the invention may be utilized to increase the stability of the stator blades 220 and the bases of the stator blades.

FIG. 3 is a perspective view of one example stator 300 that may be utilized in association with various embodiments of the invention. With reference to FIG. 3, the stator 300 may include a stator base 305 and a stator blade 310 or stator vane that is connected to the stator base 305.

According to an aspect of the invention, the stator base 305 may include one or more grooves 315 that facilitate the linking or connection of the stator base 305 to one or more other stator bases via a bracket, such as the bracket described in greater detail below with reference to FIG. 4. Any number of grooves 315 may be incorporated into the stator base 305 as desired in various embodiments of the invention. As shown in FIG. 3, certain embodiments may include a single groove 315 that follows the perimeter of the stator base 305 may be incorporated into the stator base 305. The groove 315 may be positioned at any height along the stator base 305 as desired. For example, the groove 315 may be positioned at a height that is a relatively short distance below a surface of the stator base 305 to which the stator blade 310 is connected. The groove 315 may facilitate the receipt of a portion of a bracket that is used to link stator bases. For example, as shown in FIG. 5 and discussed in greater detail below, prongs of a bracket may be inserted into the groove 315 of the stator base 305 on one side of the stator base 305 to link the stator base 305 to an adjacent stator base. Extensions from the bracket may extend into portions of the groove on opposite sides of the stator base 305 while the main body of the bracket extends into a portion of the groove that runs between the portions in which the extensions are received.

Although a single groove 315 is illustrated in FIG. 3, embodiments of the invention may include any number of grooves in the stator base 305 as desired. For example, in certain embodiments, two grooves may be provided on opposing sides of the stator base 305 and the two grooves may facilitate the receipt of a portion of a bracket that is used to link stator bases. As another example, in other embodiments of the invention, one or more slots or holes may be provided in the body of the stator base 305 to receive a portion of a bracket, such as, one or more corresponding extensions that extend from a main body of a bracket. A wide variety of different grooves and/or slots as well as shapes and configurations may be provided in the stator base 305 as desired to receive a portion of a bracket that facilitates the linking or joining of adjacent stator bases. The embodiments discussed above are provided by way of example only and are not meant to be limiting.

The one or more grooves may be formed in the stator base 305 by a suitable machining technique or machining process. Alternatively, the one or more grooves may be formed by a suitable casting technique or casting process during the production or manufacture of the stator bases. If a machining process is utilized, the machining may be conducted during the production or manufacture of the stator base 305 or, alternatively, after the stator base 305 has been manufactured. In this regard, stator bases that are already in use in a turbine or other machine may be retrofitted in order to facilitate linking of the stator bases in accordance with various embodiments of the invention.

Additionally, with reference to FIG. 3, the stator base 305 may include one or more projections 320 that facilitate securing the stator 300 to the casing or housing of a turbine component, for example, the housing or casing of the compressor section 104 discussed above with reference to FIGS. 1 and 2. Any number of projections 320 may be utilized as desired in various embodiments of the invention, for example, two projections. The one or more projections 320 may extend in the same plane from a surface 325 of the stator base 305. The surface 325 of the stator base 305 from which the one or more projections 320 extend may be referred to as the mounting surface of the stator base 305. The mounting surface 325 of the stator base 305 may be opposite a surface of the stator base to which the stator blade 310 is connected. To facilitate mounting of the stator 300 to the casing of the compressor section 104, the stator base 305 may be inserted into a groove or slot (not shown) within the casing and secured within the groove or slot by the one or more projections 320. The mounting surface 325 of the stator base 305 may have a curvature that corresponds to the curvature of the casing of the compressor section 104. Additionally, the dimensions of the stator base 305 and stator blade 310, for example, the curvature (of the mounting surface), size, and width of the stator base 305 and/or the clearance length of the stator blade 310 may be determined as desired based on the dimensions of the casing of the compressor section 104 and/or the row of stator blades or stage of the compressor section 104 that the stator 300 is included in.

FIG. 4 is a perspective view of one example bracket 400 that may be utilized to link two stators in a turbine, according to an illustrative embodiment of the invention. The bracket 400 may include a body portion 405 and a plurality of extensions or prongs 415, 420, 425, 430 that extend from the body portion 405. A first set of extensions or prongs 415, 420 may extend from the body portion 405 in a first direction. In operation, the first set of extensions 415, 420 may be inserted into one or more corresponding grooves of a first stator base, as explained in greater detail below with reference to FIG. 5. Additionally, a second set of extensions or prongs 425, 430 may extend from the body portion 405 in a second direction. In operation, the second set of extensions 425, 430 may be inserted into one or more corresponding grooves of a second stator base, as explained in greater detail below with reference to FIG. 5. In this regard, two adjacent stator bases may be linked or connected by the bracket 400. Any number of or different types of configurations for extensions or prongs may be utilized as desired in various embodiments of the invention. Additionally, various embodiments of the invention may include a different number of extensions in the first set of extensions and the second set of extensions.

According to certain embodiments of the invention, an angle θ may be formed between the first direction in which the first set of extensions 415, 420 extend and the second direction in which the second set of extensions 425, 430 extend. The angle θ may be an angle that facilitates the alignment of the various sets of extensions with the first and second stator bases. The inner surface of the casing or housing to which the first and second stator bases are connected may be curved or arcuate to facilitate surrounding a rotor. Thus, an angle may be formed between the first and second stator bases as they are connected to the casing or housing. The angle θ formed between the first direction and the second direction may account for the angle between the first and second stator bases. In this regard, the bracket 400 may be utilized to link the first and second stator bases while the first and second stator bases are connected to a casing or housing of a turbine component. The degree of the angle θ may be based at least in part on the curvature of casing or housing, and therefore, may vary in different embodiments of the invention.

Additionally, in certain embodiments of the invention, the body portion 405 of the bracket 400 may incorporate the angle θ. The body portion 405 may include portions that extend in different directions to account for the angle θ. Alternatively, the body portion 405 may include a curved portion that accounts for the angle θ. In other embodiments of the invention, at least one of the first set of extensions 415, 420 and the second set of extensions 425, 430 may extend from the body portion 405 of the bracket at an angle such that the angle θ is formed between the direction of the first set of extensions 415, 420 and the direction of the second set of extensions 425, 430.

The bracket 400 may be formed from any number of suitable materials as desired in various embodiments of the invention. Examples of suitable materials from which the bracket may be formed include, but are not limited to, metals, metal alloys, ceramic materials, synthetic materials, composites, and/or any combination of these materials. Additionally, the bracket 400 may be formed utilizing a wide variety of different techniques or methods as desired in various embodiments of the invention. For example, the bracket 400 may be machined from one or more pieces of material. As another example, the bracket 400 may be molded as a single piece. As yet another example, various components of the bracket 400 may be molded or machined and then joined or connected together, for example, by a welding process, to form the bracket 400.

FIG. 5 is a perspective view of two stator bases 505, 510 that have been linked by a bracket 515 in accordance with an illustrative embodiment of the invention. The two stator bases 505, 510 may each include similar components to the stator base 300 illustrated in FIG. 3 and described above. Additionally, the bracket 515 may be similar to the bracket 400 illustrated in FIG. 4 above.

As shown in FIG. 5, the bracket 515 may facilitate the linking of the first stator base 505 and the second stator base 510. A first set of extensions 520 of the bracket 515 may extend into a groove 525 of the first stator base 505. Similarly, a second set of extensions 530 of the bracket 515 may extend into a groove 535 of the second stator base. As shown, each stator base 505, 510 has a single groove that extends around the perimeter of the stator base 505, 510. Thus, each extension of the first set of extensions 520 may extend into a respective corresponding portion of the groove 525 of the first stator base 505. For example, a first extension may extend into a first portion of the groove 525 on a first side of the stator base 505 and a second extension may extend into a second portion of the groove 525 on a second side of the stator base 505 opposite the first side of the stator base. Similarly, each extension of the second set of extensions 530 may extend into a respective corresponding portion of the groove 535 of the second stator base 510. Although the stator bases 505, 510 are described and shown as having a single groove, certain embodiments of the invention may include stator bases with multiple grooves, and each groove may be adapted or operable to receive an extension from a bracket.

Additionally, as shown in FIG. 5, a body portion 540 of the bracket 515 may extend into the groove 525 of the first stator base 505 and/or into the groove 535 of the second stator base 510. For example, a first portion of the body portion 540 may extend into a corresponding portion of the groove 525 of the first stator base 505. Similarly, a second portion of the body portion 540 may extend into a corresponding portion of the groove 535 of the second stator base 510. In this regard, a relatively stronger connection may be facilitated between the stator bases 505, 510. Additionally, the connection formed between the stator bases 505, 510 may have a relatively low air flow loss, as explained in greater detail below.

In certain embodiments of the inventions, the bracket 515 may be removably connected to the stator bases 505, 510 as a result of being inserted into the corresponding grooves 525, 535 of the stator bases 505, 510. In other embodiments of the invention, the bracket 515 may be fixedly connected to one or more of the stator bases 505, 510 by any number of suitable connection means or connection methods, such as, screws, pins, welding, etc.

As a result of linking or connecting stator bases in a turbine component, a relatively semi-rigid ring of stator bases may be formed in a turbine component. The relatively semi-rigid ring of stator bases may be less susceptible to vibrations, stator rocking, and/or relative motion between the stators. As a result, wear on the stators and/or casing may be reduced, leading to relatively greater efficiency of the turbine component.

When mounted in a component of a machine, for example, a compressor section of a turbine, the first stator base 505 may be positioned at an angle relative to the second stator base 510. As a result of this relative angle, a gap 545 may be formed between the first stator base 505 and the second stator base 510. As shown in FIG. 5, the body portion 540 of the bracket 515 used to link the stator bases 505, 510 may extend between the stator bases 505, 510 within the gap 545. In this regard, the bracket 515 may provide a surface that reduced or eliminates air or other gases from entering the gap 545. For example, the bracket 515 may provide a surface slightly below the interior surface of the casing or housing to which the stator bases 505, 510 are connected. The surface provided by the bracket 515 may facilitate the decrease of losses due to air or other gases entering the gap 545, leading to relatively greater efficiency within the turbine component.

FIG. 6 is a flowchart of one example of a method 600 for linking stators in a machine, according to an illustrative embodiment of the invention. The method 600 may begin at block 605. At block 605, two stator bases utilized in a machine component, for example stator bases 505, 510 shown in FIG. 5, may be provided. Each of the stator bases 505, 510 or base members may include one or more grooves that facilitate linking or connecting the two stator bases 505, 510 together with a connection bracket.

At block 610, a bracket, such as, the bracket 515 illustrated in FIG. 5, may be provided for linking or connecting the two stator bases 505, 510 together. The bracket 515 may include a body and a plurality of extensions that extend from the body. A first set of two or more extensions extending from the body may be receivable by at least a portion of the one or more grooves of the first base member 505. Similarly, a second set of two or more extensions extending from the body may be receivable by at least a portion of the one or more grooves of the second base member 510.

At block 615, the two stator bases 505, 510 may be linked or connected to one another by the bracket 515 within a machine component. For example, the two stator bases 505, 510 may be inserted into a groove or slot within the machine component with the bracket 515 positioned between the two stator bases 505, 510. The bracket 515 may be operable to link the two stator bases 505, 510 together. Additionally, the bracket 515 may reduce relative motion or rocking between the two stator bases 505, 510 during the operation of the machine component, thereby leading to reduced wear within the machine component and relatively greater efficiency. The bracket 515 may also provide a surface between the two stator bases 505, 510 that improves air or gas flow within the machine component by reducing the amount of air or gas that enters a gap between the two stator bases 505, 510. In this regard, the bracket 515 may further improve the efficiency within the machine component.

The method 600 may end following block 615.

The operations described in the method 600 of FIG. 6 do not necessarily have to be performed in the order set forth in FIG. 6, but instead may be performed in any suitable order. Additionally, in certain embodiments of the invention, more or less than all of the operations set forth in FIG. 6 may be performed.

A wide variety of different type and shapes of brackets may be utilized as desired in various embodiments of the invention to link or connect one or more stators. The brackets may facilitate the linking or connection of one or more stators to reduce vibration or stator rocking of the one or more stators. Additionally, the brackets may provide a surface that facilitates the decrease of losses due to air or airflow entering the areas between adjacent stator bases.

While the invention has been described in connection with what is presently considered to be the most practical and various embodiments, it is to be understood that the invention is not to be limited to the disclosed embodiments, but on the contrary, is intended to cover various modifications and equivalent arrangements included within the spirit and scope of the appended claims.

This written description uses examples to disclose the invention, including the best mode, and also to enable any person skilled in the art to practice the invention, including making and using any devices or systems and performing any incorporated methods. The patentable scope of the invention is defined in the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A bracket for linking stators in a machine, the bracket comprising:

a body portion comprising a first edge operable to align with a base of a first stator and a second edge opposite the first edge and operable to align with a base of a second stator;

a first plurality of extensions that extend from the first edge in a first direction and that are operable to align with at least one corresponding groove on the base of the first stator and are operable to position the base of the first stator in the first direction; and a second plurality of extensions that extend from the second edge in a second direction and that are operable to align with at least one corresponding groove on the base of the second stator and are operable to position the base of the second stator in the second direction, wherein an angle of less than approximately 180 degrees is formed between the first direction and the second direction, such that the first and second plurality of extensions are operable to position the base of the first stator at the angle of less than approximately 180 degrees with respect to the base of the second stator, the angle corresponding to a curvature of a casing to which the first and second stators are attached, wherein the first plurality of extension do not align with the at least one corresponding groove on the base of the second stator and the second plurality of extension do not align with the at least one corresponding groove on the base of the first stator.

2. The bracket of claim 1, wherein the first plurality of extensions and the second plurality of extensions each comprise two extensions.

3. The bracket of claim 1, wherein the first edge of the body portion is operable to align with one of the at least one grooves on the base of the first stator, and wherein the second edge of the body portion is operable to align with one of the at least one grooves on the base of the second stator.

4. The bracket of claim 1, wherein the bracket facilitates a reduction of vibrations in the first stator and the second stator when the bracket is utilized to link the first stator and the second stator.

5. The bracket of claim 1, wherein the body portion forms a surface between the first stator and the second stator when the bracket is utilized to link the first stator and the second stator, the surface operable to facilitate the reduction of an air flow between the first stator and the second stator.

6. The bracket of claim 5, wherein the first stator and the second stator each comprise a stator surface to which a respective stator blade is attached, and wherein the surface formed by the body portion comprises a surface just below the stator surfaces.

7. A machine component, comprising:

a casing that surrounds a rotor;

a plurality of stators attached to the casing; and a bracket operable to link at least two of the plurality of stators, the bracket comprising:

a body portion comprising a first edge operable to align with a base of a first stator of the plurality of stators and a second edge opposite the first edge and operable to align with a base of a second stator of the plurality of stators;

a first plurality of extensions that extend from the first edge in a first direction and that are operable to align with at least one corresponding groove on the base of the first stator and are operable to position the base of the first stator in the first direction; and a second plurality of extensions that extend from the second edge in a second direction and that are operable to align with at least one corresponding groove on the base of the second stator and are operable to position the base of the second stator in the second direction, wherein an angle of less than approximately 180 degrees is formed between the first direction and the second direction, such that the first and second plurality of extensions are operable to position the base of the first stator at the angle of less than approximately 180 degrees with respect to the base of the second stator, the angle corresponding to a curvature of the casing, wherein the first plurality of extension do not align with the at least one corresponding groove on the base of the second stator and the second plurality of extension do not align with the at least one corresponding groove on the base of the first stator.

8. The machine component of claim 7, wherein the bracket comprises a plurality of brackets, wherein each of the plurality of brackets is operable to link two adjacent stators of the plurality of stators.

9. The machine component of claim 8, wherein a relatively semi-rigid ring of stators is formed within the machine component by linking adjacent stators of a row of stators within the machine component by the plurality of brackets.

10. The machine component of claim 7, wherein the first plurality of extensions and the second plurality of extensions each comprise two extensions.

11. The machine component of claim 7, wherein the first edge of the body portion is operable to align with one of the at least one grooves on the base of the first stator, and wherein the second edge of the body portion is operable to align with one of the at least one grooves on the base of the second stator.

12. The machine component of claim 7, wherein the bracket facilitates a reduction of vibrations in the first stator and the second stator when the bracket is utilized to link the first stator and the second stator.

13. The machine component of claim 7, wherein the body portion forms a surface between the first stator and the second stator when the bracket is utilized to link the first stator and the second stator, the surface operable to facilitate the reduction of an air flow between the first stator and the second stator.

14. A method for linking stators in a machine component, the method comprising:

providing two stator base members operable to support a respective stator blade, wherein each of the two base members comprises one or more grooves;

providing a bracket comprising a body, a first set of extensions extending in a first direction that are receivable by the one or more grooves of a first of the two base members and is operable to position the first of the two base members in the first direction, and a second set of extensions extending in a second direction that are receivable by the one or more grooves of the other base member and is operable to position the other base member in the second direction, wherein an angle of less than approximately 180 degrees is formed between the first direction and the second direction, such that the first and second set of extensions are operable to position the first of the two base members at the angle of less than approximately 180 degrees with respect to the other base member, the angle corresponding to a curvature of a casing of the machine component; and linking the two base members with the bracket within the machine component, wherein the first plurality of extension do not align with the at least one corresponding groove on the base of the second stator and the second plurality of extension do not align with the at least one corresponding groove on the base of the first stator.

15. The method of claim 14, wherein providing a bracket comprises providing a bracket with a body having a first edge operable to align with one of the one or more grooves of the first base member and a second edge operable to align with one of the one or more grooves of the second base member.

16. The method of claim 14, wherein linking the two base members with the bracket facilitates a reduction of vibrations in the two base members.

17. The method of claim 14, wherein the body of the bracket forms a surface between the two base members that facilitates a reduction of air flow between the two base members when the two base members are linked by the bracket.

* * * * *